United States Patent [19]

Bateman

[11] 4,077,387

[45] Mar. 7, 1978

[54] SELF EXTINGUISHING FIRE PIT

[76] Inventor: Donald L. Bateman, 215 7th St., Ogden, Utah 84404

[21] Appl. No.: 690,439

[22] Filed: May 27, 1976

[51] Int. Cl.[2] ..... F24C 15/08

[52] U.S. Cl. ..... 126/8; 126/25 C; 126/29

[58] Field of Search ..... 126/25 A, 29, 30, 25 C, 126/25 R, 8, 137, 220

[56] References Cited

U.S. PATENT DOCUMENTS

| | | | |
|---|---|---|---|
| 1,198,601 | 9/1916 | Sullivan | 126/220 |
| 2,161,669 | 6/1939 | Freeman | 126/25 R |
| 2,740,397 | 4/1956 | Schaefer | 126/137 |
| 3,378,002 | 4/1968 | Hink | 126/25 A |
| 3,515,118 | 6/1970 | Beller | 126/29 |
| 3,606,066 | 9/1971 | Anderson | 126/25 C |

*Primary Examiner*—John J. Camby
*Assistant Examiner*—Larry I. Schwartz
*Attorney, Agent, or Firm*—Criddle, Thorpe & Western

[57] ABSTRACT

A self extinguishing fire pit designed to fit flush with or extend above a level surface consisting of three basic parts including a wall, a rim which fits about the top of the wall, and a lid which is adapted to fit into the rim which serves to extinguish any flame or fire which has been kindled within the wall. Other attachments and/or modifications are also described.

9 Claims, 6 Drawing Figures

SELF EXTINGUISHING FIRE PIT

BACKGROUND OF THE INVENTION

This invention relates to fire pits having a self extinguishing feature. More specifically, this invention relates to fire pits consisting of a fire wall, a rim which fits about the top of the fire wall, and a lid which fits within the rim and preferably rests upon the top surface of the fire wall thereby inhibiting the flow of oxygen to the flame thereby providing a self extinguishing feature.

Fire pits or fireplaces are becoming increasingly popular, both in the backyard patios as well as in national forests, state parks, private parks, campgrounds, and the like. A particular problem associated with fire pits and/or open fires is that the fire is not properly extinguished resulting in the creation of numerous forest fires each year caused by the fanning of glowing embers into action by bursts of wind and the like.

Campfire pits and the like are known in the prior art, but such are not self extinguishable. For example, U.S. Pat. No. 3,378,002 which issued Apr. 16, 1968, teaches a semi-portable fireplace for outdoor use which has a semi-portable fireplace ring and barbeque grill. However, such apparatus has a draft passage means extending radially through the wall adjacent the lower end and does not contain any self extinguishing feature.

U.S. Pat. No. 3,515,118 which issued June 2, 1970, teaches a campfire pit which is embedded into the ground having attached thereto a permanent grill or grate. Again, there is no provision for a self extinguishing feature to be associated with said fire pit.

OBJECTS OF THE INVENTION

It is an object of the present invention to therefore provide a self extinguishing fire pit.

It is also an object of the present invention to provide a self extinguishing fire pit which preferably comprises a wall, a rim adapted to fit over and about the top of the wall, and a lid insertable in the rim which, when inserted, will deprive any fire within the wall from access to air.

It is a further object of the present invention to provide a self extinguishing fire pit which may be inserted into a patio, campground or the like such that the pit will be flush with or slightly elevated from the surrounding surface or terrain.

A still further object of the present invention is to provide a self extinguishing fire pit having various attachments which provide greater freedom and adaptability in cooking to the outdoorsman.

The principal features of this invention include a veritcal fire wall which may be of any desired shape, but is preferably cylindrical and is preferably made of reinforced concrete. Seated over the upper surface of the fire wall is a rim or ring which has an inside diameter substantially the same as the outside diameter of the fire wall and has an inwardly extending lip adapted to fit over the top surface of the fire wall. The inner portion of the lip is preferably beveled from the top to the bottom of the lip portion and the self extinguishing lid has a shape adapted to fit securely within the beveled lip portion and will also preferably rest upon the inner top portion of the fire wall.

Other adaptations may be made in the invention as will be explained in the detailed description.

DRAWINGS OF THE INVENTION

DETAILED DESCRIPTION OF THE DRAWINGS

Figure 1:
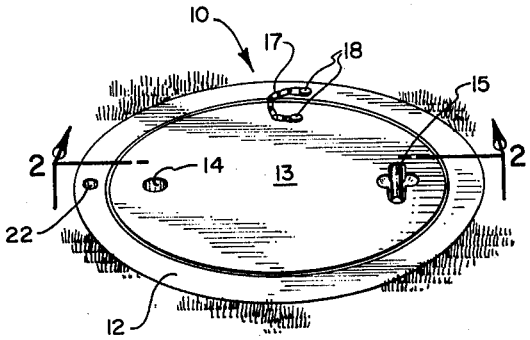
FIG. 1 is a perspective view of the fire pit mounted level with the surrounding surface showing only the rim and lid portions of the fire pit.
Figure 2:
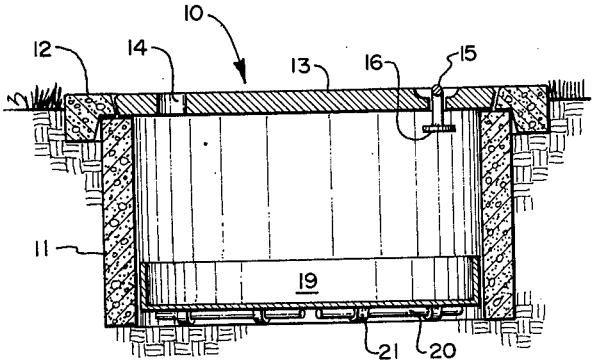
FIG. 2 is a cross-sectional view of FIG. 1 taken along lines 2—2 of FIG. 1
Figure 3:
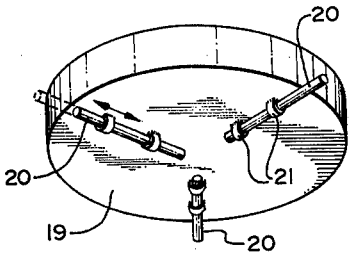
FIG. 3 is a perspective view of an ash pan or grill designed to fit into the bottom of the fire pit and adaptable for conversion into a briquet holder.

A complete embodiment of the invention is shown in FIGS. 1 and 2 with accessories being illustrated by FIGS. 3 through 6.

There is shown at FIGS. 1 and 2 a fire pit 10 which is preferably cylindrical in shape but can obviously be made of any desired shape. The fire pit 10 consists of a firewall 11 which has a flat top. Preferably, fire wall 11 is embedded either partially or completely into the surrounding surface, i.e., ground, cement, patio or other terrain. Seated around the fire wall is a rim 12 which has an inside diameter substantially the same as the outside diameter of the fire wall and which further has an inwardly protruding lip adapted to rest on the flat top portion of fire wall 11. As illustrated in the drawings, the inner edges of the lip are beveled from the top to the bottom to provide a more suitable seating means for the lid as will be defined. However, the inside edge of the rim may be in a vertical position instead of being beveled at an angle if desired. When not in use, the fire pit will be covered with lid 13 which inhibits or prevents the flow of air into the fire pit thereby extinguishing any flame that may be burning therein. FIGS. 1 and 2 illustrate two means contained in the lid for removing the lid from the fire pit. One may be a lid aperture 14 through which a finger, stick or other object may be inserted to remove the lid or place the lid over the burning fire within the pit. The other means is a handle 15 which may be fixedly mounted to always protrude above the surface of the lid or may be slidably engaged as illustrated in FIGS. 1 and 2. Such handle would have a base portion 16 attached thereto which would engage the bottom of lid 13 when the handle 15 was raised to an operative position. At a public campground or the like it may be desirable to secure the lid to the rim and/or fire wall to prevent the loss of the lid. In such case a chain or cable 17 may be attached to the rim and lid by bolts or other appropriate fastening means 18.

The bottom of the fire pit may consist of earth, cement, rock or other materials, but preferably contains an ash pan 19 which facilitates the removal of ashes after the fire has been extinguished. Preferably, ash pan 19 will be constructed of an appropriate metal such as iron, steel and the like, and consists of a horizontal bottom having raised sides which turn upwardly from the bottom, preferably at right angles. The diameter of ash pan 19 is substantially the same as the inside diameter of fire wall 11. In some instances it may be desirable to use the ash pan as a briquet holder and to place a grill over the pan for use as a cooking surface. In that event rods 20 are slidably engaged in metal loops 21. The rods can be slid outwardly and will then rest upon the top surface of rim 12, and the horizontal portion of pan 19 can be used for holding charcoal briquets. It can thus be seen that ash pan 19 may also substitute as a briquet holder by a simple modification and therefore has multiple uses.

Figure 4:
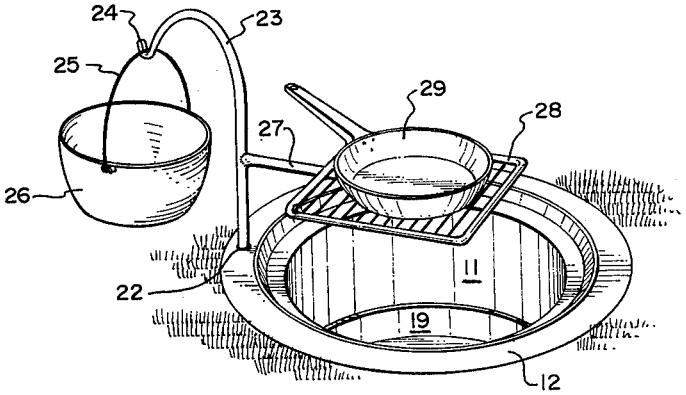
FIG. 4 is a perspective view of one operative embodiment of the fire pit having either a rotatable cooking surface or dutch oven.

FIG. 4 illustrates yet another embodiment of the invention whereby the rim 12 contains an aperture 22 into which may be inserted a vertical rodlike member 23 which may be adapted to hold various cooking implements over the fire pit. As illustrated in FIG. 4, the rodlike member 23 bends at the top in an arcuate position until said rod is angling downwardly at which point the rod again bends upwardly forming a notch 24 over which the bail 25 of a dutch oven or kettle 26 may be placed. Also, as shown in FIG. 4, the rodlike member 23 may have a horizontal rod attached thereto by means of welding, threading and the like, which rod 27 is adapted to hold a grate 28. A frying pan 29 or other cooking utensils may be placed on the grate for cooking purposes. It is obvious that rod 23 may be rotated so that either the grate or the dutch oven is over the fire pit, and when not in use, rod 23 can be lifted out of aperture 22.

Figure 5:
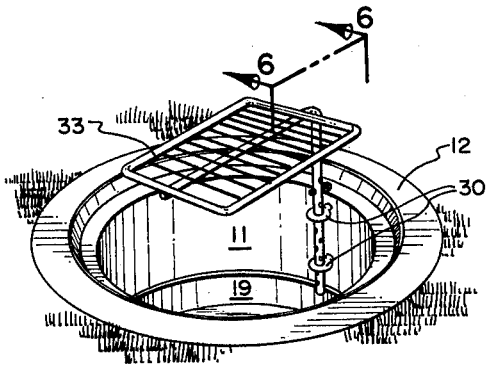
FIG. 5 is a perspective view of the fire pit showing a still different embodiment for engaging a cooking surface to the fire wall by means of a ring assembly.
Figure 6:
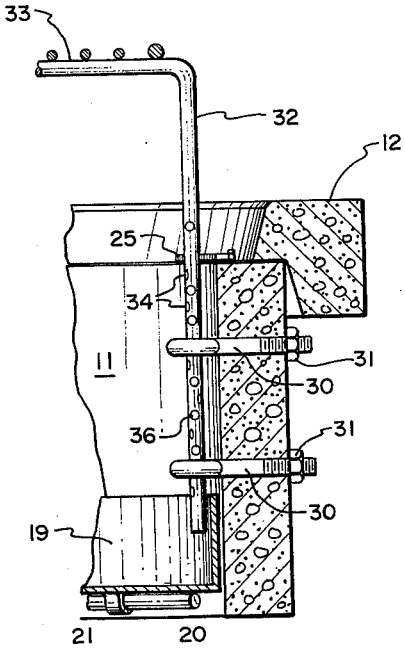
FIG. 6 is an exploded partial cross-sectional view of FIG. 5 taken along line 6—6 showing the attachment and adjustment means for affixing a cooking surface to the fire pit wall.

FIGS. 5 and 6 present still another embodiment of the present invention wherein fastening means are contained in the fire wall for securing a cooking surface over the fire pit. As shown in FIG. 6, the fastening means preferably consist of eye bolts 30 which protrude through fire wall 11 and are secured thereto by means of nuts 31. The eye bolts 30 are in vertical alignment so that a rod 32 may be inserted through the eyelet as shown. Preferably, rod 32 is bent at right angles and has a grate 33 or other cooking surface attached thereto. The positioning of the grate above the fire pit may be controlled by means of a series of apertures 34 drilled through rod 32 and held in place by means of a bolt or pin 35 which is inserted through apertures 34 and rests on the top of fire wall 11. If desired, other apertures 36 at right angles to apertures 34 may be contained in rod 32 to secure the grate away from the fire pit when it is not desired to have a cooking surface extending thereover.

The above modifications are only illustrative of the many usages that can be made of the fire pit. It should be borne in mind, however, that the single most important feature of the fire pit is the fact that lid 13 may be inserted over the fire pit whenever desired thereby extinguishing any flame therein and eliminating any danger of fire spreading beyond the confines of the fire pit itself. The fire pit may be made of any desired material, but preferably is constructed of reinforced concrete which is preferably precast and then inserted into a patio campground or other appropriate areas. In this manner it may be seen that the fire wall, the rim and the lid may be reproduced using the same set of molds and is amenable to mass production. In some instances, it may be preferable to have the lid 13 constructed of a metal in order to avoid breakage. The rim may also be constructed of a metal if desired and be bolted or otherwise fastened to the fire wall.

Although the invention as has been described is deemed to be that which would form a preferred embodiment, it is recognized that the self extinguishing feature is predominant and that many variations may be used without departing from the scope of the invention which is not limited to the details disclosed, but is to be accorded the full scope of the claims so as to include any and all equivalent devices and apparatus.

What is claimed is:

1. A self extinguishing fire pit:

a. an upwardly extending fire wall having a flat upper surface, b. a rim having an inside diameter approximately the same as the outside diameter of a fire wall encompassing the upper portion of the fire wall and having an inwardly extending lip adapted to be seated over and rest upon only the outer portion of the upper flat surface of the fire wall, c. a lid adapted to fit securely within the inwardly extending lip of the rim and rest upon the inner portion of the upper surface of the fire wall.

2. A self extinguishing fire pit according to claim 1 wherein the inwardly extending lip is beveled such that the diameter at the upper surface is greater than the diameter at the lower surface.

3. A self extinguishing fire pit according to claim 2 wherein the lid is beveled on the sides such that the diameter at the top is greater than the diameter at the bottom and the angle of the bevel is such that the beveled lid and rim coincide with each other.

4. A self extinguishing fire pit according to claim 3 wherein the fire wall, rim and lid are all cylindrical in shape.

5. A self extinguishing fire pit according to claim 4 wherein the lid and rim are interconnected by fastening means which allow removal of the lid from the fire pit for only a limited distance.

6. A self extinguishing fire pit according to claim 4 wherein the rim contains means for inserting a fixture for holding cooking implements.

7. A self extinguishing fire pit according to claim 4 wherein the fire pit contains an ash pan in the bottom comprising a flat surface having upwardly extending walls, the outside diameter of the ash pan being substantially the same as the inside diameter of the fire walls.

8. A self extinguishing fire pit according to claim 4 wherein the inner surface of the fire walls contain means for inserting a fixture for holding cooking implements.

9. A self extinguishing fire pit according to claim 4 wherein the fire pit is constructed of precast concrete and when inserted in place is substantially flush with the surrounding surface.

* * * * *